US008342875B2

(12) United States Patent
Takeuchi

(10) Patent No.: US 8,342,875 B2
(45) Date of Patent: Jan. 1, 2013

(54) BOARD-TO-BOARD CONNECTOR HAVING A SIDEWALL PORTION WITH A SLOPED GUIDE SURFACE WITH CUT OUT

(75) Inventor: Ryotaro Takeuchi, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/124,364

(22) PCT Filed: Oct. 14, 2009

(86) PCT No.: PCT/US2009/060655

§ 371 (c)(1),
(2), (4) Date: Apr. 14, 2011

(87) PCT Pub. No.: WO2010/045338

PCT Pub. Date: Apr. 22, 2010

(65) Prior Publication Data

US 2011/0201227 A1 Aug. 18, 2011

(30) Foreign Application Priority Data

Oct. 14, 2008 (JP) ..... 2008-265579

(51) Int. Cl.
*H01R 13/64* (2006.01)

(52) U.S. Cl. ..... 439/374

(58) Field of Classification Search ..... 439/74, 439/660, 78, 81, 83, 346, 374
See application file for complete search history.

(56) References Cited

U.S. PATENT DOCUMENTS

| | | | | |
|---|---|---|---|---|
| 6,793,506 | B1 * | 9/2004 | Hirata et al. | 439/74 |
| 6,976,853 | B2 * | 12/2005 | Goto | 439/74 |
| 7,264,484 | B2 * | 9/2007 | Takano | 439/74 |
| 7,425,158 | B2 * | 9/2008 | Ookura | 439/660 |
| 2005/0070137 | A1 | 3/2005 | Goto | |
| 2006/0035489 | A1 | 2/2006 | Goto | |
| 2006/0276060 | A1 | 12/2006 | Takano | |
| 2007/0105408 | A1 | 5/2007 | Ookura | |

FOREIGN PATENT DOCUMENTS

WO PCT/KR2004/000034 9/2004

OTHER PUBLICATIONS

International Search Report and Written Opinion for PCT/US2009/060655, Mar. 12, 2009.

* cited by examiner

*Primary Examiner* — Chandrika Prasad
(74) *Attorney, Agent, or Firm* — Timothy M. Morella

(57) ABSTRACT

A board-to-board connector comprising a first connector and a second connector is disclosed. The first connector has a first housing. Each first fitting guide portion of the first housing is provided with a protrusive sidewall portion configured to define both sides of each concave guide portion of the first housing to be connected to each side wall portion of the first housing and protrude out from a fitting face of each side wall portion of the first housing. The protrusive sidewall portion is provided with a sloped guide surface formed at an entrance end of each concave guide portion of the first housing to be inclined with respect to a longitudinal direction of the first housing.

8 Claims, 10 Drawing Sheets

BOARD-TO-BOARD CONNECTOR HAVING A SIDEWALL PORTION WITH A SLOPED GUIDE SURFACE WITH CUT OUT

BACKGROUND OF THE DISCLOSURE

1. Field of the Disclosure

The Present Disclosure relates, generally, to a board-to-board connector, and, more particularly, to a board-to-board connector having such a configuration that a sloped guide surface configured to be inclined with respect to a longitudinal direction of a first housing of a first connector is formed in an entrance end of a concaved protrusive end portion of each of first fitting guide portions formed at both ends in the longitudinal direction of the first housing so that second fitting guide portions formed at both ends in a longitudinal direction of a second housing of a second connector are inserted in the first fitting guide portions.

2. Description of the Related Art

Board-to-board connectors are typically used to couple pairs of parallel circuit boards with each other. Such connectors are attached, by fitting, to respective opposing surfaces of the circuit boards so that the boards are electrically connected to each other. An example of such a board-to-board connector may be illustrated in Japanese Patent Application No. 2008-084795.

Additionally, FIG. 10 illustrates a cross-sectional view of a conventional board-to-board connector. In FIG. 10, first connector 801 is attached to a first circuit board 891 and tightly fitted to be engaged with a second connector attached to a non-illustrated second circuit board. First connector 801 is provided with first housing 811 formed of an insulating material and plurality of first terminals 861 mounted in first housing 811. Moreover, respective tail portions 862 of first terminals 861 are connected to non-illustrated connection pads of first circuit board 891.

First fitting guide portions 821 are formed at both ends in the longitudinal direction of the first housing 811, and second fitting guide portions of a second housing of a second connector are inserted in the first fitting guide portions 821. For this, sloped surfaces 823 are formed in the first fitting guide portions 821 so that the second fitting guide portions can be smoothly guided thereto. Owing to this configuration, when the first connector 801 is fitted to be engaged with the second connector, it is possible to insert the second fitting guide portions of the second connector to be received in the first fitting guide portions 821 of the first connector 801 in an easy manner, and thus, the workability in achieving the fitting of the connectors is improved.

However, in the conventional board-to-board connector, it is difficult to perform the fitting operation in a fumbling manner, and the fitting operation takes a long period of time. Specifically, when the first connector 801 attached to the first circuit board 891 and the second connector attached to the second circuit board are tightly fitted to be engaged with each other, depending on the working conditions, an operator is requested to perform the fumbling operation for fitting in a state of being unable to visually recognize a fitting face of the first housing 811 and a fitting face of the second housing. In such a case, the operator may have to fumble around to adjust the position and attitude of the second housing relative to the first housing 811 while the fitting face of the second housing is made to slide on the fitting face of the first housing 811, so that the second housing is inserted in the first housing 811.

However, only the slope surfaces 823 facing upward are formed on the first fitting guide portions 821. Therefore, when the relative position between the first connector 801 and the second connector is misaligned with each other in the longitudinal direction, even when the fitting face of the first housing 811 is made to slide on the fitting face of the second housing, it may be difficult to insert the second fitting guide portions of the second housing to be received in the first fitting guide portions 821 of the first connector 801. As a result, the fitting operation cannot be performed in an easy manner, and the fitting operation takes a lot of time.

SUMMARY OF THE DISCLOSURE

Therefore, it is an object of the Present Disclosure to obviate the above-described problems encountered by the conventional connector and to provide a board-to-board connector having such a configuration that a sloped guide surface configured to be inclined with respect to a longitudinal direction of a first housing of a first connector is formed in an entrance end of a concaved protrusive end portion of each of first fitting guide portions formed at both ends in the longitudinal direction of the first housing so that second fitting guide portions formed at both ends in a longitudinal direction of a second housing of a second connector are inserted in the first fitting guide portions. Therefore, the positioning and fitting engagement can be easily performed in the course of a fumbling operation for fitting by moving the second housing relative to the first housing in the longitudinal direction. Accordingly, the board-to-board connector is able to make the fumbling operation for fitting easy, to thereby complete the fitting operation in a rather short period of time and in an accurate manner, and to realize good operability and high reliability of the board-to-board connector.

Therefore, a board-to-board connector includes a first connector having a first housing mounting therein first terminals, the first housing comprising: an island portion; concave insertion portions formed on both sides of the island portion; side wall portions formed on both sides of each of the concave insertion portions; first fitting guide portions connected to both ends in a longitudinal direction of each of the side wall portions; and concave guide portions formed in the first fitting guide portions, and a second connector configured to be engaged, by tight fitting, with the first connector, the second connector having a second housing mounting therein second terminals configured to make contact with the first terminals, the second housing comprising: a recessed cavity portion in which the island portion is inserted, protrusive convex portions formed on both sides of the recessed cavity portion to be inserted in the concave insertion portions, and second fitting guide portions connected to both ends in the longitudinal direction of each of the protrusive convex portions to be inserted in the concave guide portions, wherein: each of the first fitting guide portions is provided with a protrusive sidewall portion configured to define both sides of each of the concave guide portions to be connected to each of the side wall portions and protrude out from a fitting face of each of the side wall portions; and the protrusive sidewall portion is provided with a sloped guide surface formed at an entrance end of each of the concave guide portions to be inclined with respect to a longitudinal direction of the first housing.

The board-to-board connector further has such a configuration that the sloped guide surface is formed in a boundary portion of the protrusive sidewall portion and the side wall portions so as to protrude out from the fitting face of each of the side wall portions, and that the entrance end of each of the concave guide portions having formed therein the sloped guide surface has a shape that is obliquely opened as viewed from an upper side thereof.

The board-to-board connector further has such a configuration that none of the portions of the first terminals protrude out from the fitting faces of the side wall portions and the island portion, and that none of the portions of the second terminals protrude out from fitting faces of the protrusive convex portions.

The board-to-board connector still further has such a configuration that each of the second fitting guide portions is provided with a sloped guided surface configured to be formed on each of both sides thereof and to be inclined with respect to a longitudinal direction of the second housing.

Accordingly, the board-to-board connector has a configuration in which a sloped guide surface configured to be inclined with respect to a longitudinal direction of a first housing of a first connector is formed in an entrance end of a concaved protrusive end portion of each of first fitting guide portions formed at both ends in the longitudinal direction of the first housing so that second fitting guide portions formed at both ends in a longitudinal direction of a second housing of a second connector are inserted in the first fitting guide portions. Owing to such a configuration, the positioning and the fitting engagement can be easily performed in the course of a fumbling fitting operation by moving the second housing relative to the first housing in the longitudinal direction. Therefore, the board-to-board connector is able to make a fumbling fitting operation easy, to complete the fitting operation in a short period of time and in an accurate manner, and to provide good operability and high reliability.

BRIEF DESCRIPTION OF THE DRAWINGS

The organization and manner of the structure and operation of the present disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the figures, and will be described herein in detail, specific embodiments, with the understanding that the disclosure is to be considered an exemplification of the principles of the present disclosure, and is not intended to limit the present disclosure to that as illustrated. In the embodiments illustrated herein, representations of directions such as up, down, left, right, front, rear and the like, used for explaining the structure and movement of the various elements of the present disclosure, are not absolute, but relative. If the description of the position of the elements changes, it is assumed that these representations are to be changed accordingly.

Figure 1:
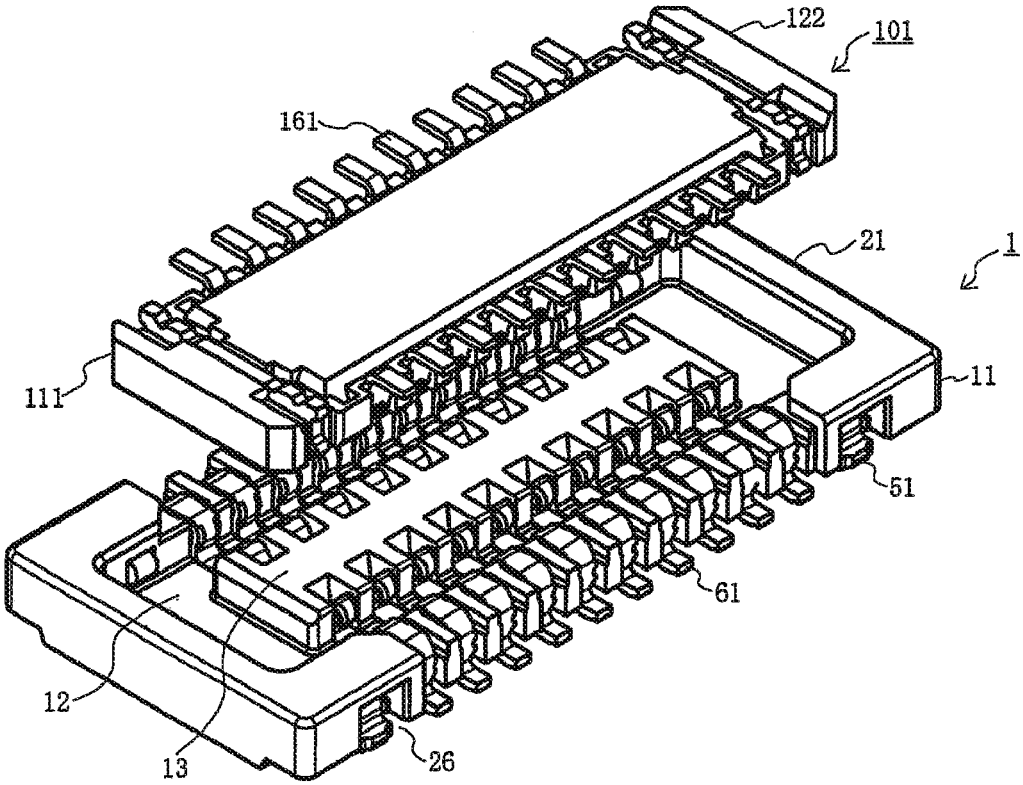
FIG. 1 is a perspective view of a first and a second connector, viewed from a fitting face of the first connector, wherein the first and second connectors are not fitted to each other.
Figure 2:
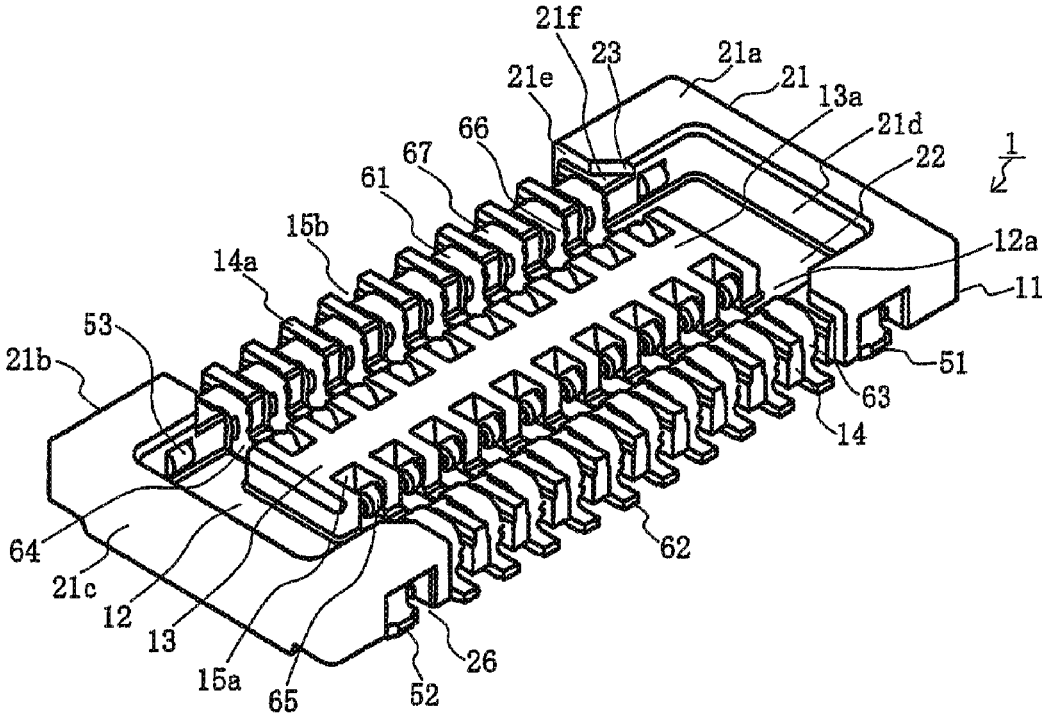
FIG. 2 is a perspective view of the first connector of FIG. 1, viewed from a fitting face.

FIG. 1 is a perspective view of a first and a second connectors of a board-to-board connector according to an embodiment of the Present Disclosure, as viewed from a fitting face of the first connector, illustrating a state where the first and second connectors are not yet engaged together by fitting; and FIG. 2 is a perspective view of the first connector according to the embodiment of the Present Disclosure, as viewed from a fitting face thereof.

In the drawing figures, a first connector, as one of a pair of connectors constituting a board-to-board connector according to the present embodiment, generally designated by reference numeral 1, is a surface-mounted type connector, which is mounted on a surface of a non-illustrated first board. Moreover, a second connector, as the other one of the connectors constituting the pair of board-to-board connector according to the present embodiment, generally designated by reference numeral 101, is a surface-mounted type connector, which is mounted on a surface of a non-illustrated second board. The board-to-board connector according to the present embodiment includes the first connector 1 and the second connector 101, and is configured to electrically connect the first board and the second board to each other. Here, the first board and the second board are printed circuit boards used, for example, in an electronic device or apparatus, and may be any type of board.

The first connector 1 includes a first housing 11 as a connector body integrally formed of an insulating material such as synthetic resin. As will be understood from the drawing figures, the first housing 11 is a generally rectangular parallelepiped member having a generally rectangular, thick plate-like shape. A concave portion 12 having a generally rectangular shape having a surrounded perimeter is formed on a side, i.e., a fitting side (the upper side in FIG. 2), where the second connector 101 is fitted. The first connector 1 has a dimension of about 10.0 mm in length, about 2.5 mm in width, and about 1.0 mm in thickness, and the dimension may be appropriately changed as required. Moreover, a first protrusive convex portion 13 provided as an island portion is formed in the concave portion 12 to be integral with the first housing 11. Furthermore, side wall portions 14 configured to extend in parallel with the first protrusive convex portion 13 are formed at both sides of the first protrusive convex portion 13 to be integral with the first housing 11. In this case, the first protrusive convex portion 13 and the side wall portions 14 protrude upwardly from a bottom portion of the concave portion 12 and extend in the longitudinal direction of the first housing 11. Owing to this configuration, recessed groove portions 12*a*, as a portion of the concave portion 12, being elongated concave insertion portions configured to extend in the longitudinal direction of the first housing 11 are formed at both sides of the first protrusive convex portion 13 to be disposed between the first protrusive convex portion 13 and the side wall portions 14. Although in the example illustrated in the drawing figures, the first protrusive convex portion 13 is singular in number, a plurality of protrusive convex portions may be provided and the number thereof is not particularly limited. In addition, the first protrusive convex portion 13 has a dimension of about 0.6 mm in width, for example, the dimension may be appropriately changed as required.

In this embodiment, first terminal-receiving inside cavities 15*a* having a recessed groove shape are formed on both side surfaces of the first protrusive convex portion 13. Moreover, first terminal-receiving outside cavities 15*b* having a recessed groove shape are formed on an upper surface 14*a* as a fitting face and along both side surfaces of each of the side wall portion 14. Since the first terminal-receiving inside cavities 15*a* and the first terminal-receiving outside cavities 15*b* are connected with each other at a bottom portion of the recessed groove portion 12*a* and are integral with each other, the first terminal-receiving inside cavities 15*a* and the first terminal-receiving outside cavities 15*b* will be collectively referred to as first terminal receiving cavities 15.

The number of first terminal receiving cavities 15 on each side of the first protrusive convex portion 13 is 10 with a pitch of about 0.4 mm, for example. Moreover, the number of first terminals 61 received in the first terminal receiving cavities 15 on each side of the first protrusive convex portion 13 is 10 with a pitch of about 0.4 mm, for example. It should be appreciated that the pitch and the number of the first terminal receiving cavities 15 may be appropriately changed as required.

The first terminals 61 are an integral member formed by applying processing, e.g., punching and bending, to a conductive metal plate. Each of the first terminals 61 is provided with a holding portion 63, a tail portion 62 connected to a lower end of the holding portion 63, an upper connection portion 67 connected to an upper end of the holding portion 63, a second contact portion 66 formed in the vicinity of an inner end of the upper connection portion 67, a lower connection portion 64 connected to the second contact portion 66, and a first contact portion 65 formed in the vicinity of a free end of the lower connection portion 64.

The holding portions 63 are portions that extend in the up-down direction, i.e., in the thickness direction of the first housing 11 to be held by being fitted in the first terminal-receiving outside cavities 15*b*. The tail portions 62 are bent to be connected to the holding portions 63 and extend in the left-right direction, i.e., outwardly in the width direction of the first housing 11 to be connected to connection pads connected to a conductive trace on the first board by means of soldering or the like. The upper connection portions 67 are bent to be connected to the holding portions 63 and extend inwardly in the width direction of the first housing 11. Moreover, the second contact portions 66 having a curved shape and configured to downwardly bend and inwardly protrude are formed at the inner ends of the upper connection portions 67. The lower connection portions 64 are portions having a generally U shape in side view and connected to the lower ends of the second contact portions 66. Furthermore, the first contact portions 65 having a curved shape and configured to bend in an U shape and outwardly protrude are formed at the free ends, i.e., in the vicinity of the inner upper ends of the lower connection portions 64.

The first terminals 61 are fitted into the first terminal receiving cavities 15 from the fitting side to be fixedly secured to the first housing 11 by the holding portions 63 being clamped by the side walls of the first terminal-receiving outside cavities 15*b* in a sandwich manner, which are disposed outside the side wall portions 14.

In the present embodiment, the upper surface 13*a* of the first protrusive convex portion 13 is a fitting face and is configured as a flat or smooth surface. Moreover, none of the portions of the first terminals 61 fixed to the first housing 11 protrude out from the upper surface 13*a* of the first protrusive convex portion 13. Furthermore, in the example illustrated in the drawing figures, the upper surface 14*a* of the side wall portion 14 is formed at a position lower (closer to the first board) than the upper surface 13*a* of the first protrusive convex portion 13. For this reason, an upper surface of the upper connection portion 67 of the first terminal 61 is almost even with the upper surface 14*a* of the side wall portion 14, but it does not protrude out from the upper surface 13*a* of the first protrusive convex portion 13. Moreover, if the upper surface of the upper connection portion 67 of the first terminal 61 is made lower than the upper surface 14*a* of the side wall portion 14, the upper surface 14*a* of the side wall portion 14 may be made even with the upper surface 13*a* of the first protrusive convex portion 13.

Furthermore, first protrusive end portions 21 as a first fitting guide portion are arranged at both ends in the longitudinal direction of the first housing 11, respectively. A concaved protrusive end portion 22 as a portion of the concave portion 12 is formed in each of the first protrusive end portions 21. The concaved protrusive end portions 22 are generally rectangular concave portions and are connected to both ends in the longitudinal direction of each of the recessed groove portions 12*a*. Moreover, the concaved protrusive end portion 22 functions as a concave guide portion in which a later-described second protrusive end portion 122 of the second connector 101 is inserted in a state where the first connector 1 and the second connector 101 are engaged by fitting together with each other.

Each of the first protrusive end portions 21 is provided with protrusive sidewall portions 21*b* configured to extend in the longitudinal direction of the first housing 11 from both ends in the longitudinal direction of the side wall portion 14 and an end wall portion 21*c* configured to extend in the short-axis direction of the first housing 11 and having both ends thereof connected to the protrusive sidewall portions 21*b*. In each of the first protrusive end portions 21, the end wall portion 21*c* and the protrusive sidewall portions 21*b* connected to both ends of the end wall portion 21*c* form a continuous side wall having an inverted C shape to thereby define three sides of the rectangular concaved protrusive end portion 22.

The upper surface 21*a* of each of the first protrusive end portions 21 is a piece of continuous flat surface having an inverted C shape extending over the entire range of the end wall portion 21*c* and the protrusive sidewall portions 21*b* connected to both ends of the end wall portion 21*c* and is formed at a position higher (distant from the first board) than the upper surface 13*a* of the first protrusive convex portion 13 and than the upper surfaces 14*a* of the side wall portions 14.

Moreover, a sloped surface portion 23 as a sloped guide surface configured to be inclined with respect to the longitudinal direction of the first housing 11 is formed in an entrance portion of each of the protrusive sidewall portions 21*b*, that is, a boundary portion with the side wall portions 14. Specifically, since the upper surface 21*a* of the first protrusive end portion 21 is located at a position higher than the upper surfaces 14*a* of the side wall portions 14, the protrusive sidewall portions 21*b* are provided with perpendicular boundary wall portions 21*e* having a flat-surface shape disposed at the boundary portions with the side wall portions 14 and configured to extend in the direction perpendicular to the longitudinal direction of the first housing 11. The inner corner portions of the perpendicular boundary wall portions 21*e* are obliquely cut out to form the sloped surface portions 23. Furthermore, although lower end surfaces 21*f* are formed in portions of the boundary portions of the protrusive sidewall portions 21*b* with the side wall portions 14 to be located at a position lower than the upper surfaces 21*a* because the corner portions of the perpendicular boundary wall portions 21*e* are cut out to form the sloped surface portions 23, the lower end surfaces 21*f* are even with the upper surfaces 14*a* of the side wall portions 14.

As a result, the entrance ends of the concaved protrusive end portions 22 of the first protrusive end portions 21 are formed into an obliquely opened shape, as viewed from an upper side thereof, because of the presence of the sloped surface portions 23 formed in the inner corner portions of the entrance end of the protrusive sidewall portions 21*b* on both sides thereof. Therefore, when the second connector 101 is made to slide in the longitudinal direction of the first housing 11, the second protrusive end portions 122 can be easily inserted in the concaved protrusive end portions 22.

Moreover, although an inclination angle of the sloped surface portions 23 with respect to the longitudinal direction of the first housing 11 as viewed from the upper side thereof is set to about 45 degrees in the example illustrated in the drawing figures, the inclination angle needs not necessarily be 45 degrees but may be 30 degrees or 60 degrees, and may be set arbitrarily. Furthermore, although the sloped surface portions 23 are flat surfaces in the example illustrated in the drawing figures, they may be curved surfaces. That is, the sloped surface portions 23 may be sloped flat surfaces and may be sloped curved surfaces.

Furthermore, first reinforcing brackets 51 as a reinforcing bracket are attached to the first protrusive end portions 21. The first reinforcing brackets 51 are an integral member formed by applying processing, e.g., punching and bending, to a metal plate and are received and held in first concave bracket holding portions 26 formed in the protrusive sidewall portions 21*b*. Moreover, tail portions 52 formed at the lower ends of the first reinforcing brackets 51 are connected to fixing pads on the first board by means of soldering or the like. Furthermore, convex engagement portions 53 formed at the upper ends of the first reinforcing brackets 51 are configured to protrude from the inner side surfaces 21*d* to be received in the concaved protrusive end portions 22 so as to be engaged with later-described second reinforcing brackets 151 of the second connector 101 in a state where the first connector 1 and the second connector 101 are engaged by fitting together with each other.

Figure 3:
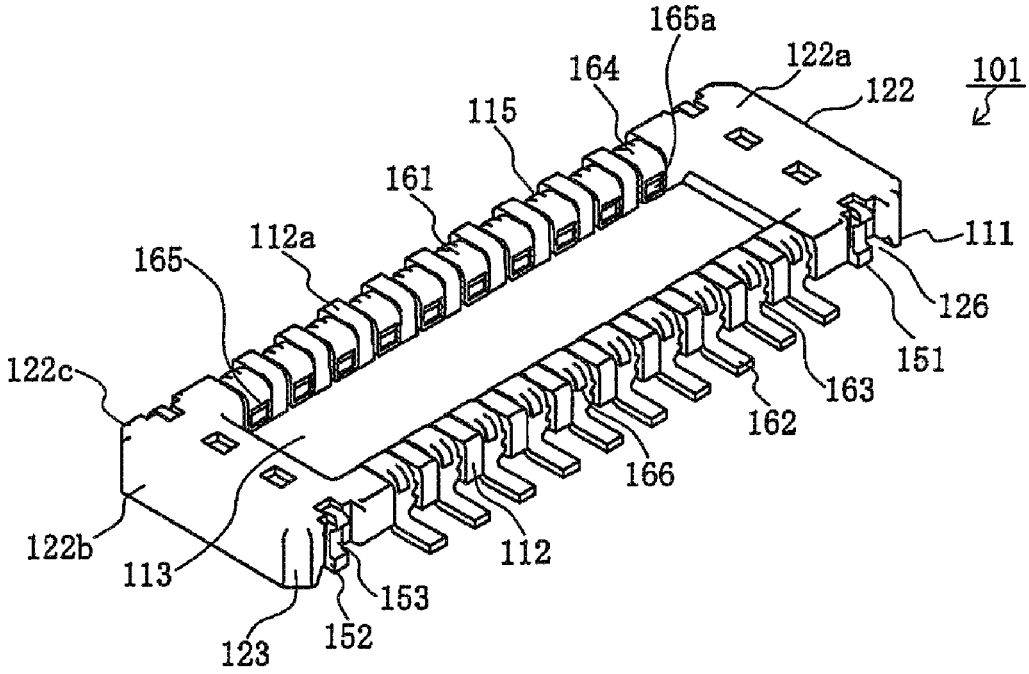
FIG. 3 is a perspective view of the second connector of FIG. 1, viewed from a fitting face.

Referring to FIG. 3, the second connector 101 includes a second housing 111 as a connector body integrally formed of an insulating material such as synthetic resin. As will be understood from the drawing figure, the second housing 111 is a generally rectangular parallelepiped member having a generally rectangular, thick plate-like shape. The second housing 111 has a dimension of about 8.0 mm in length, about 1.5 mm in width, and about 0.8 mm in thickness, and the dimension may be appropriately changed as required. Moreover, an elongated recessed cavity portion 113 configured to extend in the longitudinal direction of the second housing 111 and second protrusive convex portions 112 as an elongated protrusive convex portion configured to define the outer sides of the recessed cavity portion 113 and extend in the longitudinal direction of the second housing 111 are integrally formed on a side, i.e., a fitting side (the upper side in the drawing figure) of the second housing 111 where the first connector 1 is fitted. The second protrusive convex portions 112 are formed along both sides of the recessed cavity portion 113 and along both sides of the second housing 111. Moreover, second terminals 161 are arranged in each of the second protrusive convex portions 112.

As illustrated in the drawing figure, the recessed cavity portion 113 is closed by a bottom portion at a surface thereof on a side, i.e., a mounting surface (the lower surface side in the drawing figure) where it is mounted on the second board. Moreover, although in the example illustrated in the drawing figure, the number of second protrusive convex portions 112 is two, it may be singular in number and the number thereof is not particularly limited. The recessed cavity portion 113 has a dimension of about 0.7 mm in width, for example, and the dimension thereof may be appropriately changed as required.

The second terminals 161 are an integral member formed by applying processing, e.g., punching and bending to a conductive metal plate. Each of the second terminals 161 is provided with a holding portion 163 also functioning as a second contact portion, a tail portion 162 connected to a lower end of the holding portion 163, a connection portion 164 connected to an upper end of the holding portion 163, and a first contact portion 165 connected to an inner end of the connection portion 164. Moreover, concaved contact portions 165*a* configured to be engaged with the first contact portions 65 of the first terminals 61 are formed on the surface of the first contact portions 165. Furthermore, convexed contact portions 166 configured to be engaged with the second contact portions 66 of the first terminals 61 are formed in the vicinity of the upper ends of the holding portions 163.

The holding portions 163 are portions that are held with a perimeter thereof surrounded by the second housing 111 and make contact with the second contact portions 66 of the first terminals 61. The tail portions 162 are bent to be connected to the holding portions 163 and extend outwardly in the width direction of the second housing 111 to be connected to connection pads connected to a conductive trace on the second board by means of soldering or the like. The connection portions 164 are bent to be connected to the holding portions 163 and extend inwardly in the width direction of the second housing 111. The first contact portions 165 are portions that are downwardly bent to be connected to inner ends of the connection portions 164 and extend downwardly.

Moreover, second terminal receiving cavities 115 are formed along both side surfaces and an upper surface 112*a* of the second protrusive convex portion 112 so that the second terminals 161 are received in the second terminal receiving cavities 115. In the present embodiment, the upper surface 112*a* of the second protrusive convex portion 112 is a fitting face and is configured as a flat or smooth surface. The upper surface 112*a* as the fitting face functions as a reference surface for engagement between the first connector 1 and the second connector 101, together with the upper surface 13*a* of the first protrusive convex portion 13 of the first connector 1. Therefore, none of the portions of the upper surface of the connection portion 164 of the second terminals 161 protrude out from the upper surface 112*a*. Although the upper surface of the connection portion 164 is even with the upper surface 112*a* in the example illustrated in the drawing figure, it may be positioned at a lower side than the upper surface 112*a*.

The number of second terminal receiving cavities 115 on each side of the recessed cavity portion 113 is 10 with a pitch of about 0.4 mm, for example. Moreover, the number of second terminals 161 received in the second terminal receiving cavities 115 on each side of the recessed cavity portion 113 is 10 with a pitch of about 0.4 mm, for example. It should be appreciated that the pitch and the number of the second terminal receiving cavities 115 may be appropriately changed as required.

Furthermore, second protrusive end portions 122 as a second fitting guide portion are arranged at both ends in the longitudinal direction of the second housing 111, respectively. Each of the second protrusive end portions 122 is a thick member that extends in the short-axis direction of the second housing 111 and has both ends thereof connected to both ends in the longitudinal direction of the second protrusive convex portion 112, and an upper surface 122*a* thereof is a generally rectangular flat surface. Moreover, the second protrusive end portions 122 are portions which are inserted in the concaved protrusive end portions 22 of the first protrusive end portions 21 of the first connector 1 in a state where the first connector 1 and the second connector 101 are engaged by fitting together with each other. Furthermore, the upper surface 122*a* may be formed to be even with the upper surface 112*a* of the second protrusive convex portion 112 and may function as the fitting face together with the upper surface 112*a*.

Although in the example illustrated in the drawing figure, the boundary portions between the outer end of the upper surface 122*a* and an end side surface 122*b* and left and right side surfaces 122*c* of the second protrusive end portion 122, that is, corner portions on the surrounding three sides of the second protrusive end portion 122 are subjected to chamfering processing, the chamfering processing may be omitted.

Moreover, sloped surface portions 123 as a sloped guided surface configured to be inclined with respect to the longitudinal direction of the second housing 111 are formed at both side ends of the second protrusive end portion 122, that is, at the boundary portions of the end side surface 122*b* and left and right side surfaces 122*c*. Specifically, the corner portions of the boundaries of the end side surface 122*b* and the left and right side surfaces 122*c* are obliquely cut out to form the sloped surface portions 123.

As a result, the both outer ends of the second protrusive end portions 122 are formed into an obliquely cut shape, as viewed from an upper side thereof, because of the presence of the sloped surface portions 123. Therefore, when the second connector 101 is made to slide in the longitudinal direction of the first housing 11 of the first connector 1, the second protrusive end portions 122 can be easily inserted in the concaved protrusive end portions 22 of the first protrusive end portions 21.

Moreover, although an inclination angle of the sloped surface portions 123 with respect to the longitudinal direction of the first housing 11 as viewed from the upper side thereof is set to about 45 degrees in the example illustrated in the drawing figure, the inclination angle needs not necessarily be 45 degrees but may be 30 degrees or 60 degrees, and may be set arbitrarily. Furthermore, although the sloped surface portions 123 are flat surfaces in the example illustrated in the drawing figure, they may be curved surfaces. That is, the sloped surface portions 123 may be sloped flat surfaces and may be sloped curved surfaces. It should be appreciated that the sloped surface portions 123 may be omitted if not necessary.

Furthermore, second reinforcing brackets 151 as a reinforcing bracket are attached to the second protrusive end portions 122. The second reinforcing brackets 151 are an integral member formed by applying processing, e.g., punching and bending, to a metal plate and are received and held in second concave bracket holding portions 126 formed in the second protrusive end portion 122. Moreover, tail portions 152 formed at the lower ends of the second reinforcing brackets 151 are connected to fixing pads on the second board by means of soldering or the like. Furthermore, concave engagement portions 153 formed at the upper ends of the tail portions 152 are configured to be engaged with the convex engagement portions 53 of the first reinforcing brackets 51 of the first connector 1 in a state where the first connector 1 and the second connector 101 are engaged by fitting together with each other.

Figure 4:
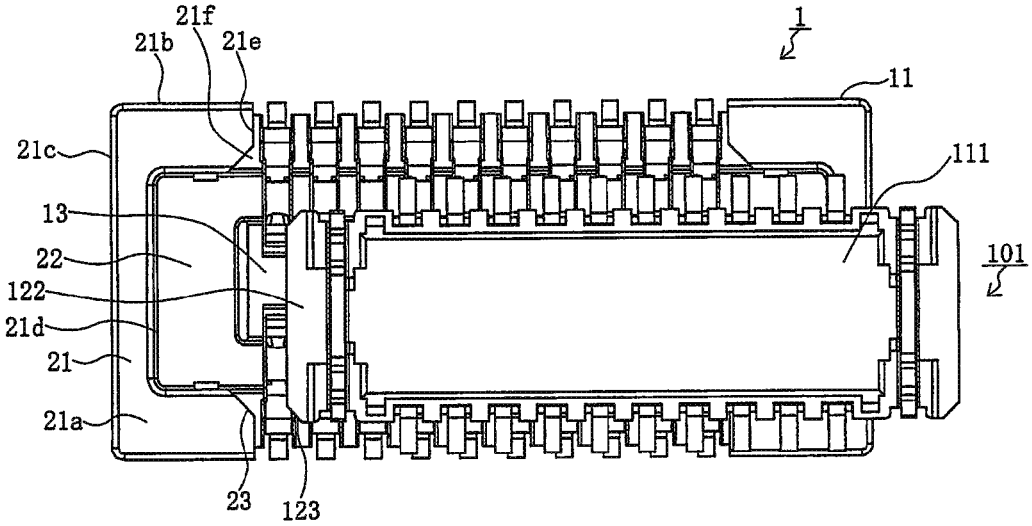
FIG. 4 is a top plan view illustrating the positional relationship between the first connector and the second connector of FIG. 1, showing a first step of a fitting operation.
Figure 5:
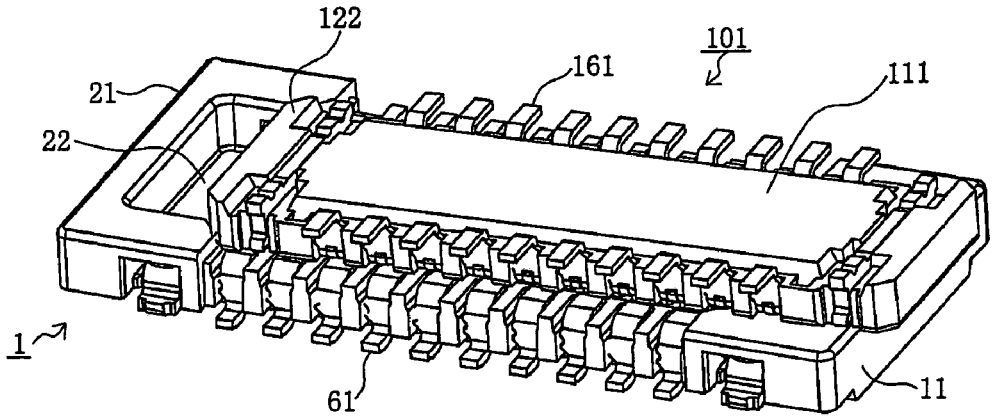
FIG. 5 is a perspective view illustrating the positional relationship between the first connector and the second connector of FIG. 1, showing a second step of the fitting operation.
Figure 6:
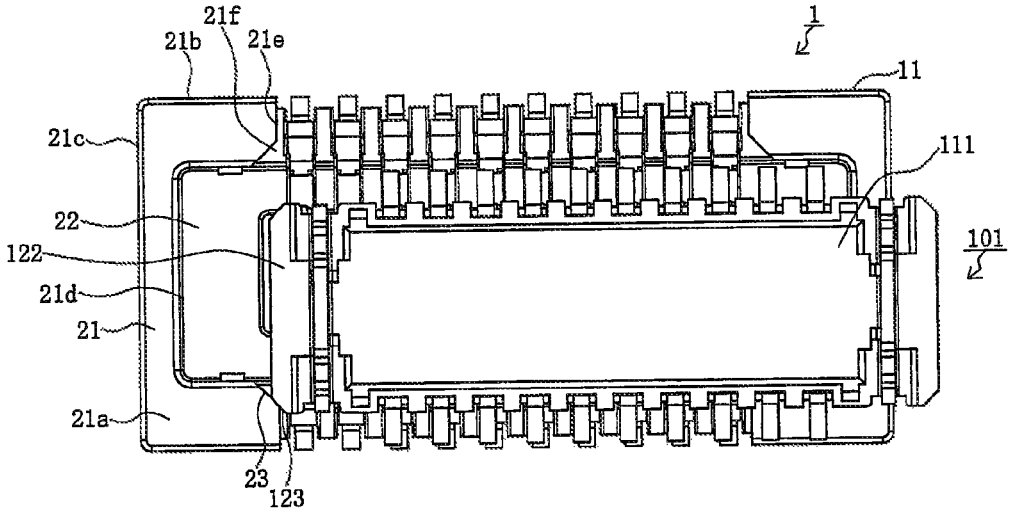
FIG. 6 is a top plan view illustrating the positional relationship between the first connector and the second connector of FIG. 1, showing the second step of the fitting operation.
Figure 7:
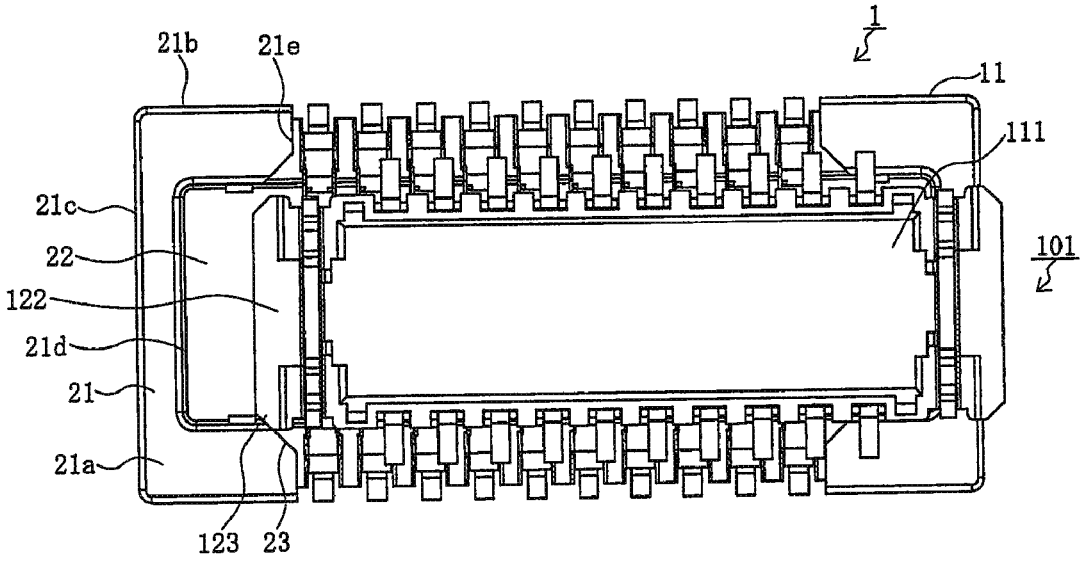
FIG. 7 is a top plan view illustrating the positional relationship between the first connector and the second connector of FIG. 1, showing a third step of the fitting operation.
Figure 8:
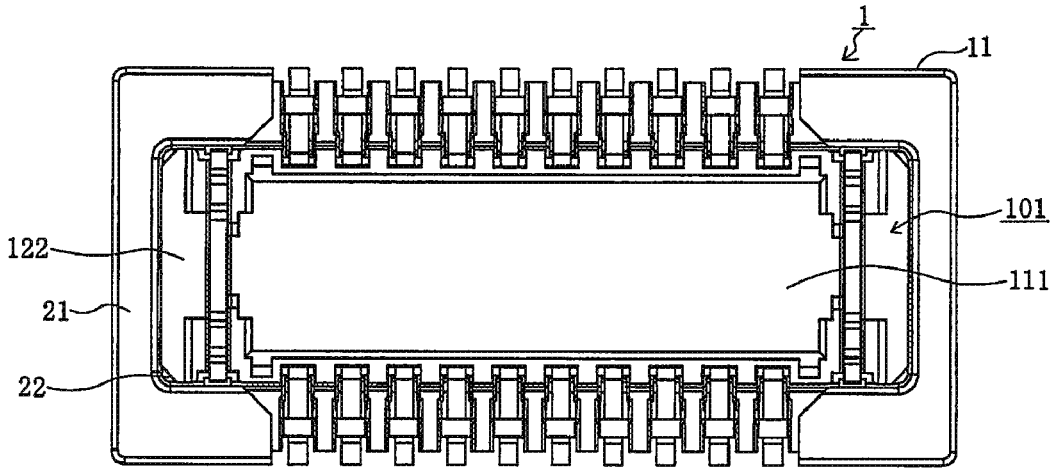
FIG. 8 is a top plan view illustrating the positional relationship between the first connector and the second connector of FIG. 1, showing a fourth step of the fitting operation.
Figure 9:
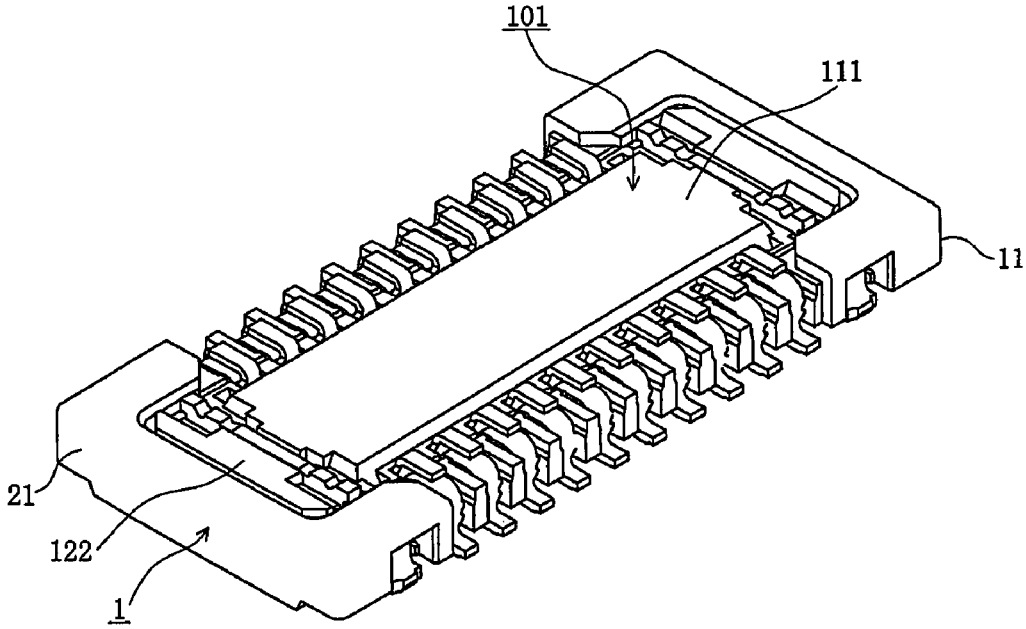
FIG. 9 is a perspective view illustrating the positional relationship between the first connector and the second connector of FIG. 1.
Figure 10:
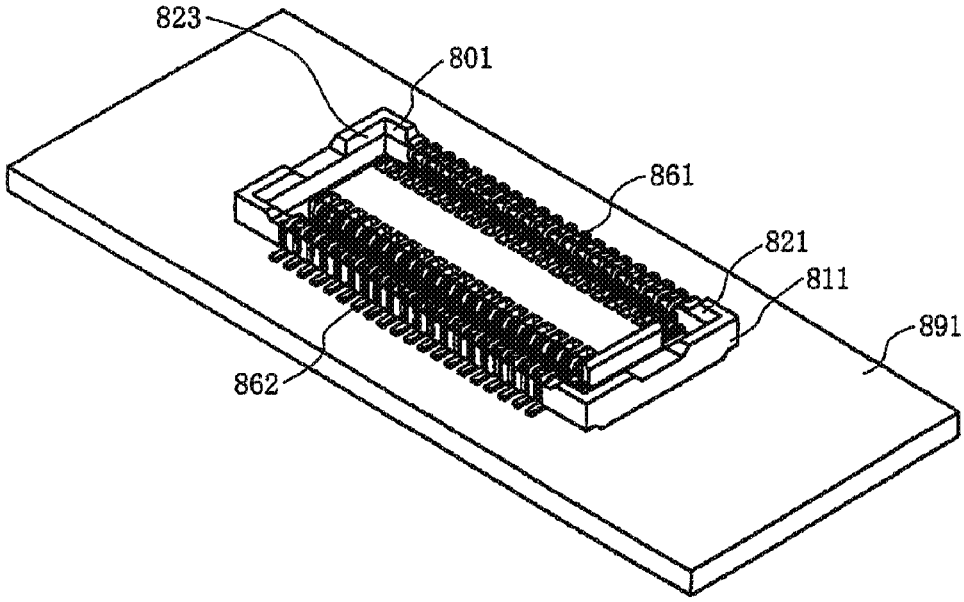
Prior art FIG. 10
FIG. 10 is a perspective view of a conventional board-to-board connector.

FIG. 4 is a top plan view illustrating the positional relationship between the first and second connector according to the embodiment of the Present Disclosure, showing a first step of a fitting operation; FIG. 5 is a perspective view illustrating the positional relationship between the first and second connector according to the embodiment of the Present Disclosure, showing a second step of the fitting operation; FIG. 6 is a top plan view illustrating the positional relationship between the first and second connector according to the embodiment of the Present Disclosure, showing the second step of the fitting operation; FIG. 7 is a top plan view illustrating the positional relationship between the first and second connector according to the embodiment of the Present Disclosure, showing a third step of the fitting operation; FIG. 8 is a top plan view illustrating the positional relationship between the first and second connector according to the embodiment of the Present Disclosure, showing a fourth step of the fitting operation; and FIG. 9 is a perspective view illustrating the positional relationship between the first and second connector according to the embodiment of the Present Disclosure.

In this embodiment, the first connector 1 is assumed to be surface-mounted on the first board in a state where the tail portions 62 of the first terminals 61 are connected to connection pads connected to a non-illustrated conductive trace on the first board by means of soldering or the like and the tail portions 52 of the first reinforcing brackets 51 are connected to the fixing pads on the first board by means of soldering or the like.

Similarly, the second connector 101 is assumed to be surface-mounted on the second board in a state where the tail portions 162 of the second terminals 161 are connected to connection pads connected to a non-illustrated conductive trace on the second board by means of soldering or the like and the tail portions 152 of the second reinforcing brackets 151 are connected to the fixing pads on the second board by means of soldering or the like.

In this embodiment, since the first connector 1 and the second connector 101 are mounted on the first board and the second board having a large area, respectively, it will be described that an operator performs a fumbling fitting operation in a state of being unable to see the fitting face of the first connector 1 and the fitting face of the second connector 101.

First, the operator moves the first connector 1 and/or the second connector 101 in a direction toward either one of the connectors, i.e., in the fitting direction, in a state where the fitting face of the first connector 1 opposes the fitting face of the second connector 101 so that a portion of the fitting face of the first connector 1 makes abutting contact with a portion of the fitting face of the second connector 101. In this case, since the operator performs the fitting operation in a fumbling manner, the positioning cannot be performed in an accurate manner, and thus, as illustrated in FIG. 4, the position of the first connector 1 is misaligned with respect to the position of the second connector 101. Moreover, the first terminals 61 do not protrude out from the fitting face of the first connector 1, and the second terminals 161 do not protrude out from the fitting face of the second connector 101. Therefore, in this state, the first terminals 61 and the second terminals 161 are separated apart from each other and are not in contact with each other. For this reason, even when the first connector 1 and the second connector 101 are made to slide relative to each other, the first terminals 61 and the second terminals 161 are not brought into contact with each other and are not damaged.

Specifically, the central axis in the longitudinal direction of the second connector 101 is located on the lower side in the drawing figures with respect to the central axis in the longitudinal direction of the first connector 1, and the central axis in the short-axis direction of the second connector 101 is located on the right side in the drawing figures with respect to the central axis in the short-axis direction of the first connector 1. Therefore, the second protrusive end portions 122 of the second housing 111 are located on the right lower side in the drawing figures of the concaved protrusive end portions 22 of the first protrusive end portions 21.

When the operator moved the second connector 101 in the leftward direction relative to the first connector 1 while the first connector 1 and the second connector 101 slide relative to each other, as illustrated in FIGS. 5 and 6, the sloped surface portions 123 formed at both side ends of the second protrusive end portion 122 of the second housing 111 are brought into abutting contact with the sloped surface portions 23 formed in the entrance ends of the protrusive sidewall portions 21*b* of the first protrusive end portions 21 of the first housing 11. Specifically, in FIG. 6, the sloped surface portion 123 formed in the left-lower corner portion of the second protrusive end portion 122 on the left side of the second housing 111 is brought into abutting contact with the sloped surface portion 23 formed on the right side end of the lower protrusive sidewall portion 21*b* of the first protrusive end portion 21 on the left side of the first housing 11.

In such a state, when the operator moves the second connector 101 in the leftward direction relative to the first connector 1, the left-lower corner portion of the second protrusive end portion 122 is moved along the sloped surface portion 23 of the protrusive sidewall portion 21*b*, so that the second connector 101 is moved upward in FIG. 6 relative to the first connector 1. That is, the central axis in the longitudinal direction of the second connector 101 is moved in a direction toward the central axis in the longitudinal direction of the first connector 1.

Subsequently, when the operator further moves the second connector 101 in the leftward direction relative to the first connector 1, as illustrated in FIG. 7, the misalignment between the central axis in the longitudinal direction of the first connector 1 and the central axis in the longitudinal direction of the second connector 101 becomes small, so that the left-lower corner portion of the second protrusive end portion 122 of the second housing 111 reaches a position located in the vicinity of the inner side surface 21*d* of the protrusive sidewall portion 21*b*.

Subsequently, when the operator further moves the second connector 101 in the leftward direction relative to the first connector 1, the second connector 101 is moved further upward in FIG. 7 relative to the first connector 1. Moreover, the central axis in the longitudinal direction of the second connector 101 becomes almost identical with the central axis in the longitudinal direction of the first connector 1, and the position of the second protrusive end portion 122 of the second housing 111 becomes almost identical with the position of the concaved protrusive end portion 22 of the first protrusive end portion 21 of the first housing 11 with respect to the up-down direction in FIG. 7. Therefore, the second protrusive end portion 122 on the left side of the second housing 111 becomes able to be inserted, from the right side, in the concaved protrusive end portion 22 on the left side of the first housing 11.

For this reason, when the operator further moves the second connector 101 in the leftward direction relative to the first connector 1, the second protrusive end portion 122 on the left side of the second housing 111 is moved leftward to be received in the concaved protrusive end portion 22 on the left side of the first housing 11. Moreover, as illustrated in FIG. 8, the end side surface 122*b* of the second protrusive end portion 122 is brought into abutting contact with the inner side surface 21*d* of the end wall portion 21*c*. In this way, the first connector 1 and the second connector 101 are in a state where the positioning thereof is carried out.

That is, when the end side surface 122*b* of the second protrusive end portion 122 on the left side of the second housing 111 is brought into abutting contact with the inner side surface 21*d* of the end wall portion 21*c* of the first protrusive end portion 21 on the left side of the first housing 1, the second protrusive end portion 122 on the left side of the second housing 111 is located at a position right above the concaved protrusive end portion 22 on the left side of the first housing 1. On the other hand, as illustrated in FIG. 8, the second protrusive end portion 122 on the right side of the second housing 111 is located at a position right above the concaved protrusive end portion 22 on the right side of the first housing 1. Moreover, although not clearly illustrated in FIG. 8, the second protrusive convex portions 112 of the second housing 111 are located at positions right above the recessed groove portions 12*a* of the first housing 1. Furthermore, the recessed cavity portion 113 of the second housing 111 is located at a position right above the first protrusive convex portion 13 of the first housing 1. That is, the central axes in the longitudinal direction and the short-axis direction of the second connector 101 become almost identical with the central axes in the longitudinal direction and short-axis direction of the first connector 1, and the first connector 1 and the second connector 101 are in a state where the positioning thereof is carried out with respect to a direction parallel with the fitting face.

Therefore, when the operator moves the second connector 101 in the fitting direction relative to the first connector 1, i.e., in a direction (a direction perpendicular to the drawing sheet of FIG. 8) perpendicular to the fitting face where the first board and the second board are moved toward either one of the boards, the fitting engagement between the first connector 1 and the second connector 101 starts. Then, the second protrusive convex portions 112 on the left and right sides of the second connector 101 are inserted into the recessed groove portions 12*a* on the left and right sides of the first connector 1 so that the first contact portions 65 of the first terminals 61 are brought into contact with the first contact portions 165 of the second connector 161, and the second contact portions 66 of the first terminal 61 are brought into contact with the holding portions 163 of the second terminals 161.

In this way, as illustrated in FIG. 9, when the fitting engagement between the first connector 1 and the second connector 101 is completed, the first terminals 61 and the second terminals 161 are electrically connected to each other. As a result, the conductive trace connected to the connection pads on the first board being connected to the tail portions 62 of the first terminals 61 are electrically connected to the conductive trace connected to the connection pads on the second board being connected to the tail portions 162 of the second terminals 161. In this case, since the first terminals 61 and the second terminals 161 make multi-point contact with each other, it is possible to certainly maintain stable electrical connection.

Moreover, the first contact portions 65 of the first terminals 61 are in a state where they are engaged with the concaved contact portions 165*a* of the second terminals 161, while the second contact portions 66 of the first terminals 61 are in a state where they are engaged with the concaved contact portions 166 of the second terminals 161. Furthermore, the convex engagement portions 53 of the first reinforcing brackets 51 of the first connector 1 are in a state where they are engaged with the concave engagement portions 153 of the second reinforcing brackets 151 of the second connector 101. Owing to this configuration, it is difficult to remove the second connector 101 from the first connector 1 even upon receipt of a force that releases the fitting between the first connector 1 and the second connector 101, that is, upon receipt of a removal force for removing the second connector 101 from the first connector 1. That is, a necessary removal force is increased.

As described above, in the present embodiment, the entrance ends of the concaved protrusive end portions 22 formed at both ends in the longitudinal direction of the first housing 11 of the first connector 1 are inclined with respect to the longitudinal direction of the first housing 11 so that the second protrusive end portions 122 formed at both ends in the longitudinal direction of the second housing 111 of the second connector 101 are inserted in the concaved protrusive end portions 22. Owing to such a configuration, the second protrusive end portions 122 can be easily inserted in the concaved protrusive end portions 22 in the course of a fumbling fitting operation by moving the second housing 111 relative to the first housing 11 in the longitudinal direction. Therefore, the positioning of the first connector 1 and the second connector 101 can be easily performed, and the fitting engagement between the first connector 1 and the second connector 101 can be easily performed.

Moreover, none of the portions of the first terminals 61 protrude out from the upper surfaces 14*a* of the side wall portions 14 and from the upper surface 13*a* of the first protrusive convex portion 13, and none of the portions of the second terminals 161 protrude out from the upper surface 112*a* of the second protrusive convex portion 112. Owing to such a configuration, even when the first connector 1 and the second connector 101 are moved to slide relative to each other in the course of the fumbling fitting operation, the first terminals 61 and the second terminals 161 are not caught at each other by being brought into abutting contact with each other, and thus, the first terminals 61 and the second terminals 161 are not damaged.

Furthermore, since the sloped surface portions 123 are formed at both outer ends of the second protrusive end portion 122, when the second connector 101 is made to slide in the longitudinal direction of the first housing 11, the second protrusive end portion 122 are easily inserted in the concaved protrusive end portion 22 of the first protrusive end portion 21.

The Present Disclosure is not limited to the above-described embodiments, and may be changed or modified in various ways based on the gist of the Present Disclosure, and these changes and modification are not eliminated from the scope of the Present Disclosure as claimed in the attached claims.

What is claimed is:

1. A board-to-board connector, the board-to-board connector comprising:

a first connector, the first connector including a first housing mounting therein first terminals, the first housing including:

an island portion;

concave insertion portions formed on both sides of the island portion;

side wall portions formed on both sides of each concave insertion portion;

first fitting guide portions connected to both ends in a longitudinal direction of each side wall portion; and concave guide portions formed in each first fitting guide portion, and a second connector configured to engage the first connector, the second connector including a second housing mounting therein second terminals configured to make contact with the first terminals, the second housing including:

a recessed cavity portion in which the island portion is inserted;

protrusive convex portions formed on both sides of the recessed cavity portion to be inserted in the concave insertion portions; and second fitting guide portions connected to both ends in the longitudinal direction of each protrusive convex portion to be inserted in the concave guide portions;

wherein:

each first fitting guide portion is provided with a protrusive sidewall portion configured to define both sides of each concave guide portion to be connected to each side wall portion and protrude out from a fitting face of each side wall portion; and the protrusive sidewall portion is provided with a sloped guide surface formed at an entrance end of each concave guide portion, the sloped guide surface forming a cut out of the protrusive sidewall portion, the plane of the cut out being oblique to a longitudinal direction of the first housing.

2. The board-to-board connector of claim 1, wherein the sloped guide surface is formed in a boundary portion of the protrusive sidewall portion and the side wall portions so as to protrude out from the fitting face of each side wall portion.

3. The board-to-board connector of claim 2, wherein the entrance end of each concave guide portion having formed therein the sloped guide surface has a shape that is obliquely opened as viewed from an upper side thereof.

4. The board-to-board connector of claim 3, wherein each second fitting guide portion is provided with a sloped guided surface configured to be formed on each of both sides thereof and inclined with respect to a longitudinal direction of the second housing.

5. The board-to-board connector of claim 1, wherein none of the portions of the first terminals protrude out from the fitting faces of the side wall portions and the island portion.

6. The board-to-board connector of claim 3, wherein none of the portions of the second terminals protrude out from fitting faces of the protrusive convex portions.

7. The board-to-board connector of claim 6, wherein each second fitting guide portion is provided with a sloped guided surface configured to be formed on each of both sides thereof and inclined with respect to a longitudinal direction of the second housing.

8. The board-to-board connector of claim 1, wherein each second fitting guide portion is provided with a sloped guided surface configured to be formed on each of both sides thereof and inclined with respect to a longitudinal direction of the second housing.

* * * * *